US006938561B1

(12) United States Patent
Vogler et al.

(10) Patent No.: US 6,938,561 B1
(45) Date of Patent: Sep. 6, 2005

(54) DEVICE FOR PRODUCING A ROTATING FLOW

(75) Inventors: Erich Vogler, Zurich (CH); Peter Straub, Stallikon (CH); Gérard Capitaine, Genthod (CH); Jean-Pierre Budliger, Plan-les-Ouates (CH)

(73) Assignee: Von Roll Umwelttechnik AG, Zurich (CH)

( * ) Notice: Subject to any disclaimer, the term of this patent is extended or adjusted under 35 U.S.C. 154(b) by 805 days.

(21) Appl. No.: 09/650,533

(22) Filed: Aug. 30, 2000

(30) Foreign Application Priority Data

Aug. 30, 1999 (CH) ..... 1585/99

(51) Int. Cl.[7] ..... F23B 5/00; F23G 7/06; F23J 15/00; F23L 9/04

(52) U.S. Cl. ..... 110/213; 110/210; 110/345; 110/348

(58) Field of Search ..... 110/189, 210, 211, 110/212, 213, 346, 342, 345, 344, 343, 347, 110/348, 235

(56) References Cited

U.S. PATENT DOCUMENTS

| | | | | | |
|---|---|---|---|---|---|
| 3,788,796 | A | * | 1/1974 | Krippene et al. | 431/2 |
| 4,570,551 | A | * | 2/1986 | Derbidge et al. | 110/263 |
| 4,810,186 | A | * | 3/1989 | Rennert et al. | 431/175 |
| 5,020,456 | A | * | 6/1991 | Khinkis et al. | 110/345 |
| 5,078,064 | A | * | 1/1992 | Breen et al. | 110/212 |
| 5,252,298 | A | | 10/1993 | Jones | |

FOREIGN PATENT DOCUMENTS

| | | | | |
|---|---|---|---|---|
| DE | 196 48 639 | | 4/1998 | |
| DE | 197 05 938 | | 8/1998 | |
| JP | 55-105104 | | 8/1980 | |
| JP | 62-18802 | | 5/1987 | |
| JP | 4-55609 | | 2/1992 | |
| JP | 5-26421 | * | 5/1993 | ..... F23G 5/00 |
| JP | 5-113208 | * | 5/1993 | ..... F23G 5/00 |
| JP | 6-272836 | * | 6/1994 | ..... F23G 5/30 |
| JP | 7-103440 | | 4/1995 | |
| JP | 10-205734 | | 8/1998 | |
| JP | 10-288325 | | 10/1998 | |
| JP | 11-51367 | | 2/1999 | |
| WO | WO 95 35409 | | 12/1995 | |

* cited by examiner

*Primary Examiner*—Kenneth Rinehart
(74) *Attorney, Agent, or Firm*—Ostrolenk, Faber, Gerb & Soffen, LLP; Klaus P. Stoffel

(57) ABSTRACT

A device for producing a rotating flow in a rectangular flow duct which has a flue-gas outlet of an incineration plant, in particular of a garbage incineration plant, and a transition region from a combustion chamber of the incineration plant to the flue-gas outlet. First wall sections on two opposite walls define the flow duct and have a wall width b. The first wall sections have a length $l_1$ of at least approximately 0.4b<0.8b. These first wall sections, with the center longitudinal axis of the flow duct as axis of symmetry, are centrosymmetrically opposite one another and are defined on the one side by the adjacent wall. In the first wall sections, first nozzles for media which can be emitted in the form of a jet are oriented in a row in an injection plane in such a way that they inject a jet into the injection plane, the angle lying in the injection plane between the wall and an injected jet being at least approximately 90°.

18 Claims, 6 Drawing Sheets

DEVICE FOR PRODUCING A ROTATING FLOW

BACKGROUND OF THE INVENTION

1. Field of the Invention

The invention relates to a device for producing a rotating flow in a flow duct which comprises a flue-gas outlet of an incineration plant, in particular of a garbage incineration plant.

2. Discussion of the Prior Art

Such devices are used in order to regulate by means of the injected media the composition of the flue-gas mixture conveyed through the flow duct of an incineration plant and the temperature and dwell time of the flue-gas mixture. However, the composition, temperature and dwell time are not only to be regulated but in particular are also to be evened out. In this way, optimum secondary combustion of the flue-gas mixture can be ensured and the desired, low emission values can be maintained. This necessitates complete intermixing of the flue-gas mixture. Attempts are made to achieve this complete intermixing by producing rotating flows in the flow duct by means of devices having appropriate nozzle arrangements.

U.S. Pat. No. 5,252,298, for example, discloses a device of the generic type. The nozzles arranged in a plane are oriented tangentially to an imaginary circle in the center of the flow duct, so that a rotating flow is produced in the flow duct. In a device disclosed by DE-A-19 648 639, the flow rate is controlled by means of nozzles arranged opposite one another in the flow duct in such a way that at least two flows rotating in opposition are obtained in the flow duct. The problem with these known rotating flows consists in the fact that a virtually vortex-free eye arises in the center of the flow, with the result that complete intermixing and thus uniform composition, temperature distribution and dwell time are not obtained.

SUMMARY OF THE INVENTION

The object of the present invention is therefore to provide an efficient device with which complete intermixing of flue-gas mixtures in the flow duct of an incineration plant is obtained.

Due to the special arrangement, pursuant to the present invention, of first nozzles in an injection plane in at least one first wall section per wall, which wall section is diagonally opposite the at least one first wall section of the opposite wall and due to the orientation of the first nozzles in the injection plane in such a way that the angle lying in the injection plane between the wall and an injected jet is at least approximately 90°, a rotating flow is produced in the flow duct on the one hand and very good intermixing of the flue-gas mixture is achieved on the other hand. In this case, "diagonally opposite" means that the first wall sections, for the swirling of the flowing material in the projection approximately in the direction of the jet flowing in through the first nozzles, do not overlap or only partly overlap laterally. In particular, a distribution of first nozzles over first wall sections having a length l of 50% and more ensures that jets of injected media pass right into the center of the flow duct. By the sum L of the lengths of the first wall sections of one wall being at least approximately 40% up to 80% of the total wall width b, i.e. by the first nozzles extending only over part of the width b of the wall, material costs and assembly costs for the nozzles are saved, the efficiency of the intermixing being maintained.

In a special embodiment, in addition to the first nozzles, second nozzles are provided in the injection plane in a second wall section at an angle β relative to the first nozzles and oriented diagonally toward the center of the flow duct, a factor which further improves the intermixing. A plurality of first wall sections and in particular also a plurarlity of second wall sections having first and second nozzles respectively are preferably provided for each wall, so that vortex regions having vortices rotating in opposite directions are produced, which further improves the intermixing.

It is especially advantageous to orient the second nozzles with an injection component in the downstream direction at an angle α relative to the injection plane. In this case, each of the second nozzles having an injection component may be at a different angle α relative to the injection plane or else all the second nozzles inject jets with an injection component into the flow duct in the same plane tilted by the angle α relative to the injection plane. In this way, the jets of these nozzles can be set in such a way that they flow helically into one another.

In a further preferred embodiment, first nozzles are arranged in a first wall section on all four walls defining the flow duct. In this case, the first wall sections lie in the peripheral direction against the rotating flow in each case at the start of a wall, so that they are at a distance from the first wall section of the adjacent wall and do not touch one another. Due to this distribution of the first wall sections and their length of more than 0.5b, a very good rotating flow can be produced, and optimum intermixing of the flue-gas mixture can be achieved by the injection from all four sides right into the center of the flow duct.

It is especially advantageous to arrange the nozzles of all four walls in one injection plane. However, the nozzles may also be arranged in two parallel injection planes which are at a distance from one another in the direction of flow, opposite nozzles being arranged in one plane.

Wall sections which are centrosymmetrically opposite one another are ideally the same length.

Fresh secondary air and/or recirculated flue gas is advantageously injected. If fresh secondary air and recirculated flue gas are injected, annular gap nozzles are preferably provided. In this case, the core jet of the annular gap nozzles consists of recirculated flue gas and the annular jet consists of fresh secondary air.

A control system by means of which the flow rates of the media to be emitted in the form of jets can be controlled independently of one another at least for nozzles arranged on opposite walls is especially advantageous.

If at least one injection plane is arranged in the region of a flame cover of the incineration plant, the flame cover being situated in the transition region between a combustion chamber and the flue-gas outlet, in addition to the intermixing and regulation of the flue-gas mixture, cooling of the flame cover exposed to very high thermal loading is achieved by the injection of the media to be emitted in the form of jets.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In a purely schematic manner in FIGS. 1 to 6 of the drawing.

DETAILED DESCRIPTION OF THE PREFERRED EMBODIMENTS

Figure 1A:
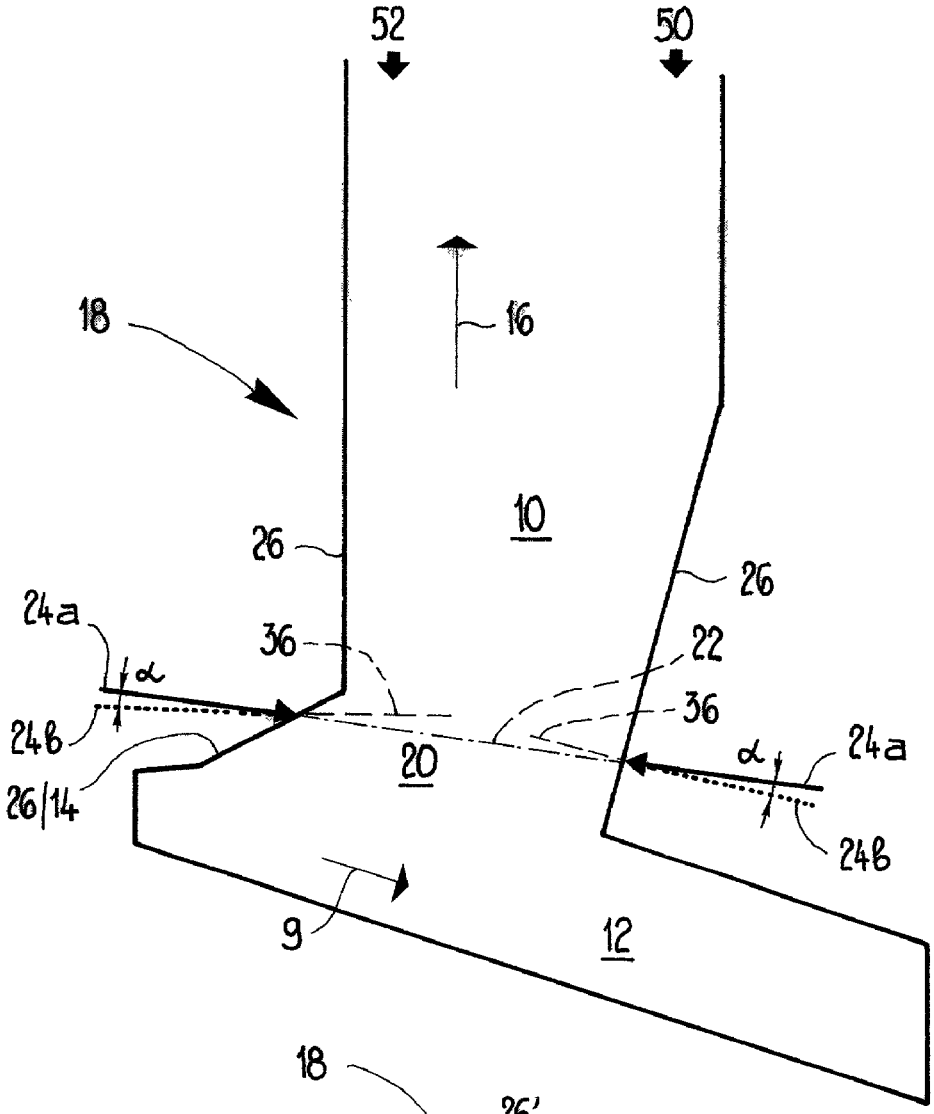
FIGS. 1*a, b* show a first embodiment of the device according to the invention, with first nozzles and second nozzles arranged on two opposite walls of a rectangular flow duct, FIG. 1*a* showing the section along the flow duct and FIG. 1*b* showing a section transverse to the flow duct.

In FIGS. 1*a* to 4*a*, of a garbage incineration plant, in each case a section of a flue-gas outlet 10 and a combustion chamber 12 and a transition region 20 between combustion chamber 12 and flue-gas outlet 10 with a flame cover 14 are shown in section along the flue-gas outlet 10. Provided for the discharge of flue-gas mixtures produced during the combustion is a rectangular flow duct 18, which comprises the transition region 20 from the combustion chamber 12 to the flue-gas outlet 10 and the flue-gas outlet 10. The basic direction of flow of the flue-gas mixture is identified by an arrow 16. In FIGS. 1*b* to 4*b*, in each case sections are shown transversely to the flow duct 18 in the region of an injection plane 22, in which nozzles 24 for the injection of media which can be emitted in the form of a jet are arranged. The nozzles 24 and their orientation are shown by arrows in all the representations. The direction of flow of the garbage is identified by an arrow 9.

All the embodiments shown in FIGS. 1*a* to 4*b*, on at least two opposite walls 26, have first wall sections 28 having a length $l_1$ of at least approximately 40% to 80% of the wall width b of a wall 26. The first wall sections 28, with the center longitudinal axis 32 of the flow duct 18 as a geometric axis of symmetry, are in each case centrosymmetrically opposite one another and are defined on one side by the adjacent wall 26. In the first wall sections 28 centrosymmetrically opposite one another, a row of first nozzles 24*a* are arranged in an injection plane 22. The first nozzles 24*a* are oriented in the injection plane 22 so that they inject a jet into the latter, the angle $\gamma$ which lies in the injection plane between injected jet 30 and wall 26 being approximately 90°. This arrangement of nozzles 24 permits good intermixing of the flue-gas mixture, which is caused to rotate in the flow duct 18 and flows in direction 16.

In all the examples, the injection plane 22 lies in the region of the flame cover 14, which is arranged in the transition region 20 between flue-gas outlet 10 and combustion chamber 12. The flame cover 14 either has nozzles 24 passing through it itself, as shown in all four examples, and/or it is "flushed from below" with media which can be emitted in the form of a jet, as shown in FIGS. 2 to 4, via nozzles 24*a*', 24*b*" which are arranged in walls 26 laterally below the flame cover 14. In this way, the flame cover 14 can be cooled by the injected media.

Figure 1B:
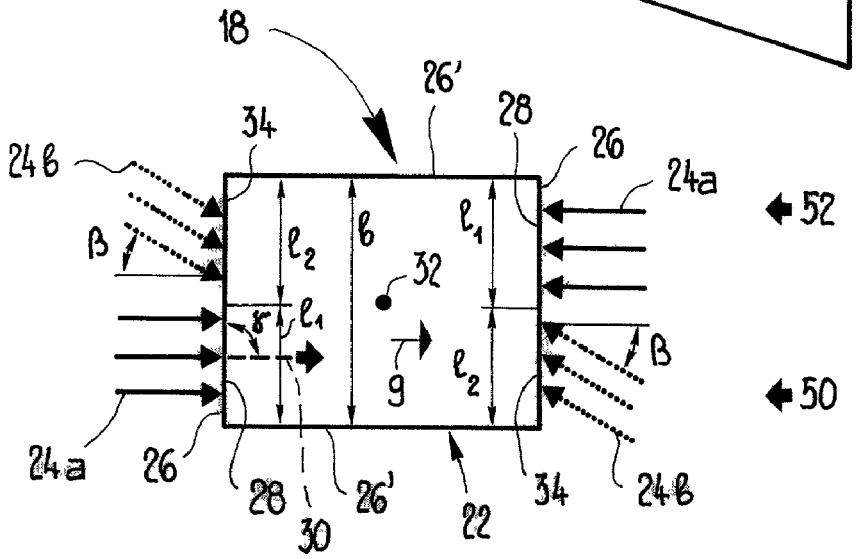

Shown in FIGS. 1*a* and 1*b* is an embodiment in which first wall sections 28 having a length $l_1$ of about 40% to 50% of the wall width b are provided on two opposite walls 26. Complementing the row of first nozzles 24*a* in the first wall section 28, second nozzles 24*b* lie in a second wall section 34 having a length $l_2$ and are oriented at an angle $\beta$ to the first nozzles 24*a* diagonally toward the center, representing the center longitudinal axis 32, of the flow duct 18. The angle $\beta$ in this example is about 25°, but may be between 20° and 50°. The lengths $l_1$ and $l_2$ of the two wall sections 28, 34 complement one another in this example to make the total wall width b, although this need not necessarily be the case. Relative to the injection plane 22, the second nozzles 24*b* are oriented in a common plane 36, which is tilted by the angle $\alpha$ relative to the injection plane 22. The angle $\alpha$ in this example is about 10°, but may vary and may be between 5° and 15°. The second nozzles 24*b* are oriented in such a way that the jets 30 produced by them flow helically into one another. Instead of being oriented in a common plane 36, the second nozzles 24*b* may also be oriented so as to be tilted at individual angles $\alpha$ relative to the injection plane 22.

Figure 2A:
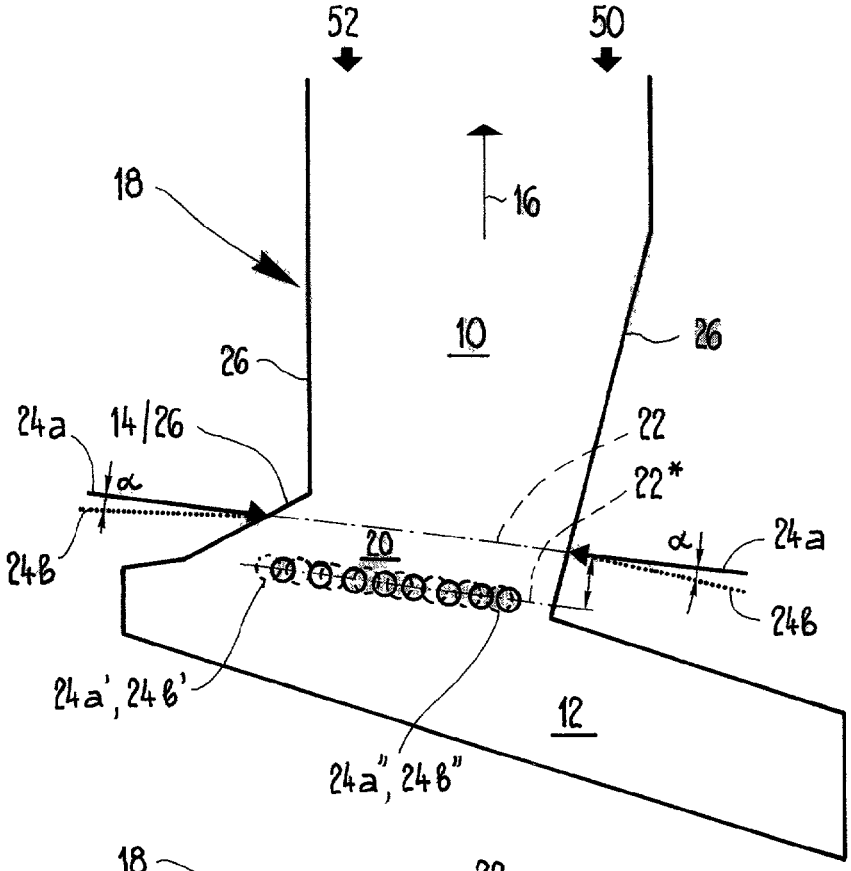
FIGS. 2*a, b, c* show a second embodiment of the device with an arrangement of the nozzles similar to that from FIGS. 1*a* and 1*b*, although nozzles are likewise arranged on the other two walls of the rectangular flow duct, specifically in a second parallel injection plane at a distance from the first injection plane in the direction of flow, and the representation in FIG. 2*a* is analogous to that from FIG. 1*a* and the representations in FIGS. 2*b* and 2*c* are analogous to those from FIG. 1*b;*
Figure 2B:
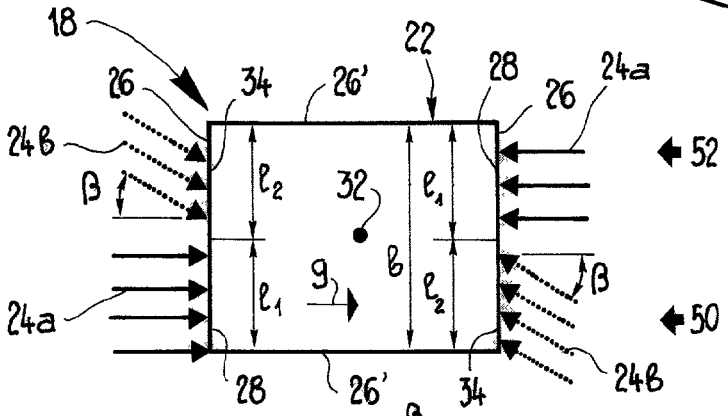
Figure 2C:
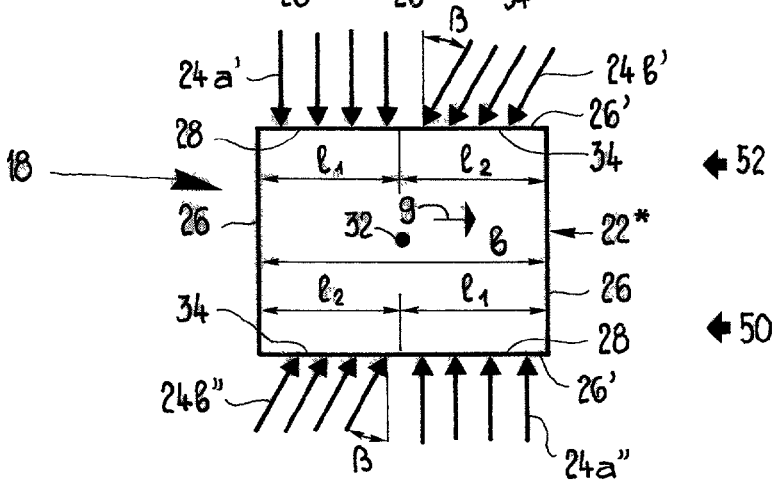

Shown in FIGS. 2*a* to 2*c* is an embodiment in which, on all four walls 26 of the flow duct 18, first nozzles 24*a* are arranged in a first wall section 28 and second nozzles 24*b* are arranged in a second wall section 34 in a similar manner to the embodiment shown in FIGS. 1*a* and 1*b*. In this case, the first wall sections 28 are arranged in the peripheral direction against the rotating flow in each case at the start of a wall 26. The nozzles 24*a*, 24*b* and respectively 24*a*', 24*a*", 24*b*', 24*b*" are arranged in two parallel injection planes 22 and 22* respectively which are at a distance from one another in the direction of flow, nozzles 24 being arranged on opposite walls 26 in a common injection plane 22, 22*. The distance d between the injection planes 22, 22* may be between 0.4 m and 3 m.

Figure 3A:
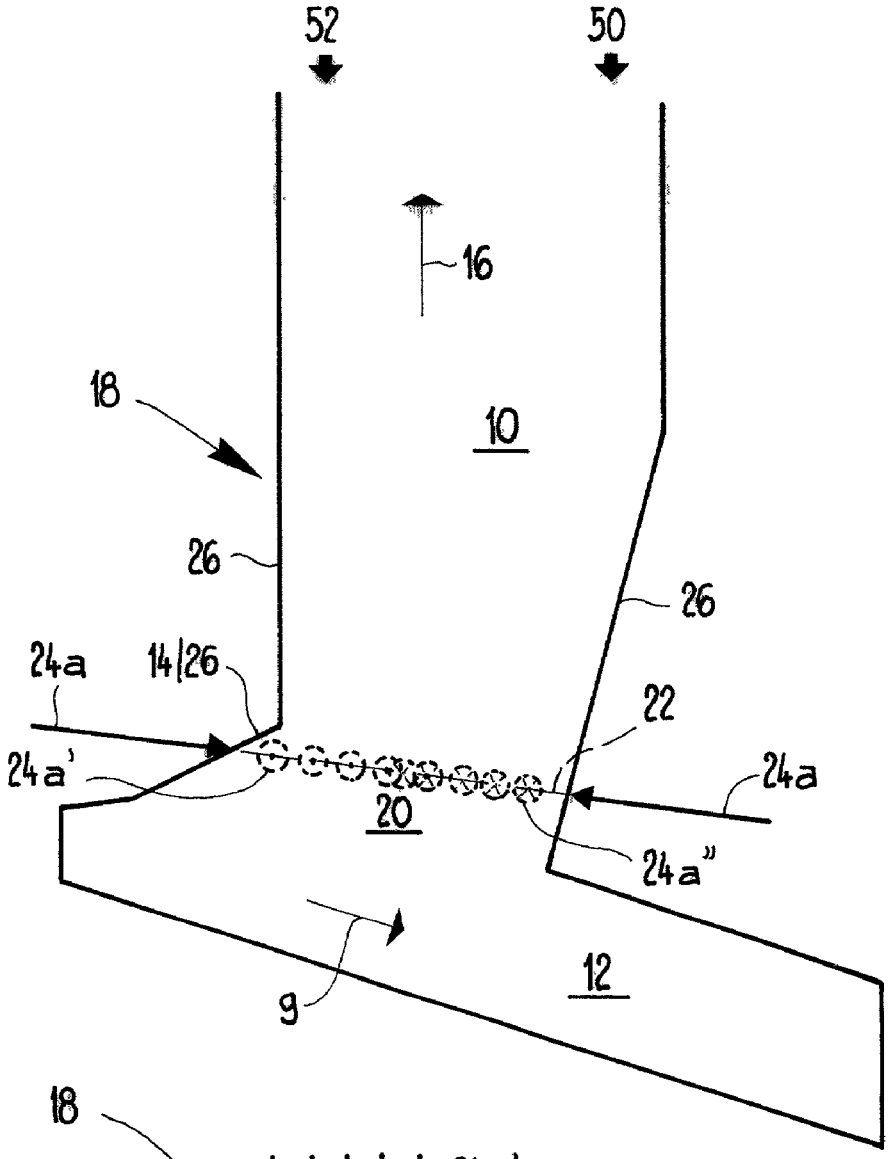
FIGS. 3*a, b* show a third embodiment of the device with first nozzles on all four walls of the rectangular flow duct in an injection plane with a representation analogous to FIGS. 1*a* and 1*b;*
Figure 3B:
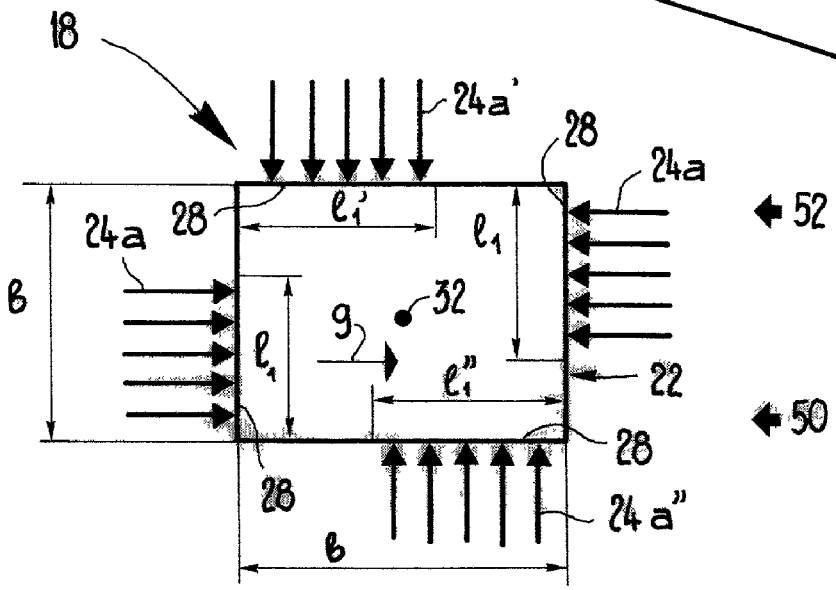

In the example shown in FIGS. 3*a*, 3*b*, first wall sections 28 having first nozzles 24*a* are arranged in a single injection plane 22 on all four walls 26 of the flow duct 18. The length $l_1$ of the first wall sections 28 is clearly greater than 0.5b, preferably around 0.55b to 0.75b. The remainder of the total wall width b of each wall 26 is free of nozzles 24. Due to this arrangement and orientation of the first nozzles 24*a*, it is possible to inject jets 30 right into the center of the rotating flow produced, so that complete intermixing of the flue-gas mixture takes place.

Figure 4A:
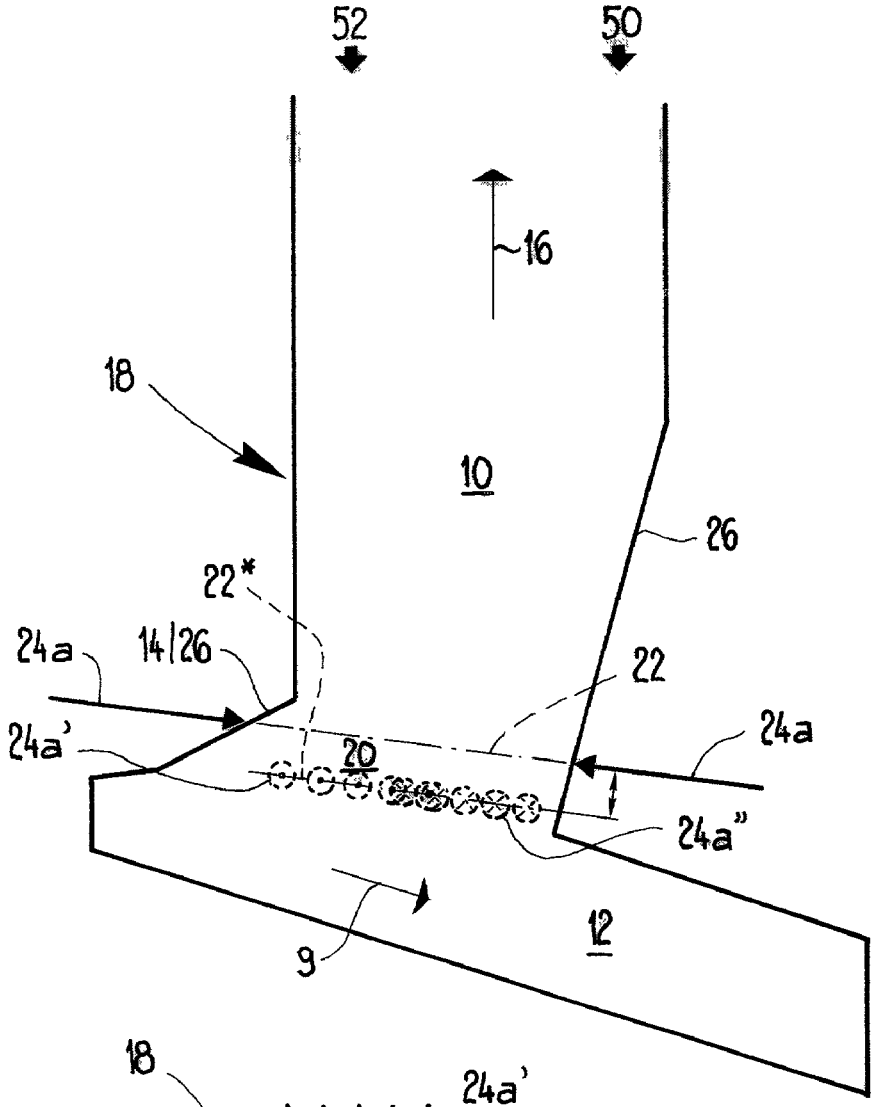
FIGS. 4*a, b* show a fourth embodiment of the device with first nozzles on all four walls of the rectangular flow duct, the nozzles being distributed in two parallel injection planes which are at a distance from one another in the direction of flow, specifically in each case first nozzles opposite one another in one injection plane and with a representation analogous to FIGS. 1*a* and 1*b;*
Figure 4B:
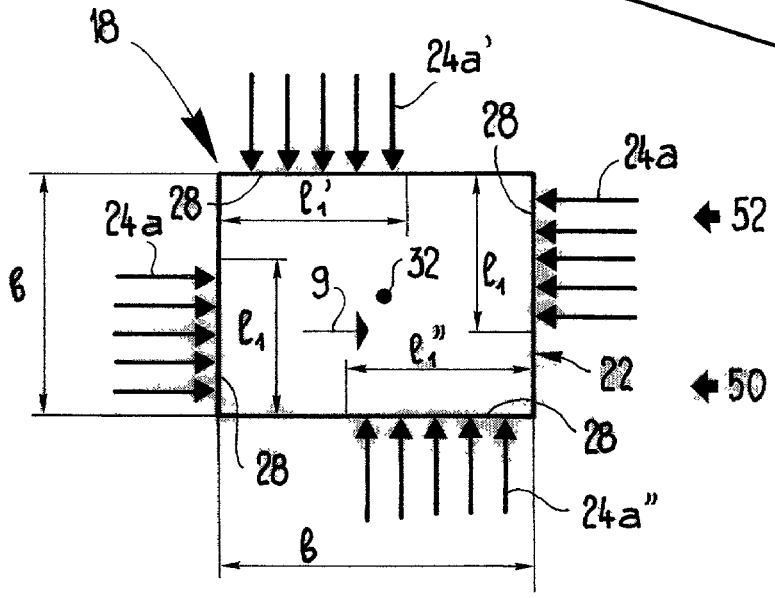

Depending on the design of the flow duct 18 and the configuration of the walls 26, it may be necessary, whether for optimization of the flow or even because the four walls 26 cannot be provided with nozzles 24*a* in a single plane, to arrange the nozzles 24*a* in two injection planes 22 and 22* parallel to one another, as shown in FIGS. 4*a*, 4*b*, instead of in a single injection plane 22 (cf. FIGS. 3*a*, 3*b*).

All the nozzles are designed in such a way that media to be injected can be injected at a pressure of 500 Pa to 5000 Pa.

Figure 5:
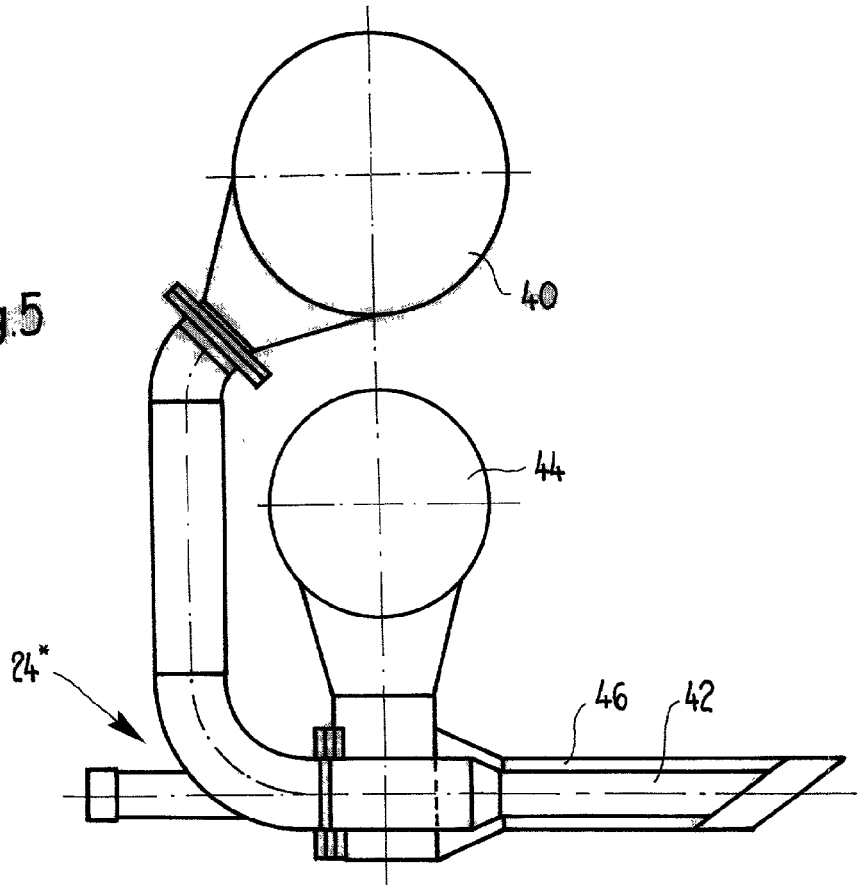
FIG. 5 shows an example of an annular gap nozzle.

Shown in FIG. 5 is an annular gap nozzle 24*, as provided, for example, for injecting fresh secondary air and recirculated flue gas. A first feed line 40 for feeding a first medium, in this case recirculated flue gas, into a nozzle part designed as core nozzle 42 and producing a core jet is shown, and a second feed line 44 for feeding a second medium, in this case fresh secondary air, into a nozzle part designed as annular gap 46 and producing an annular jet is shown.

Figure 6:
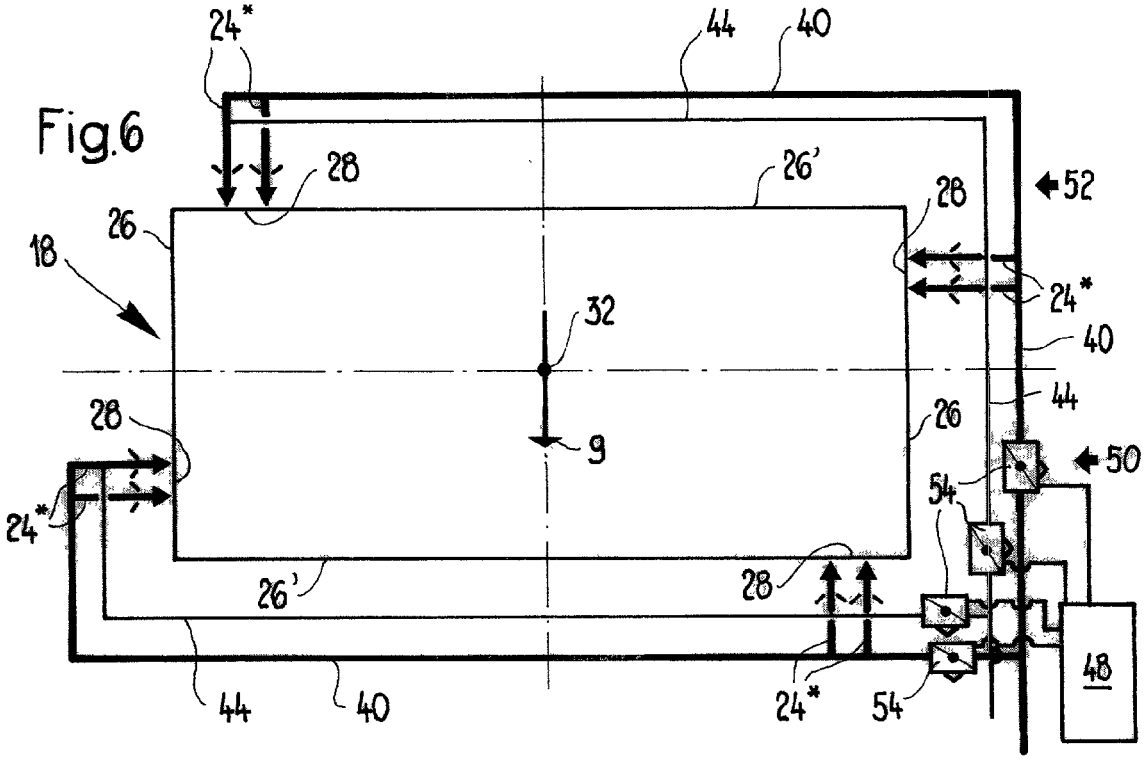
FIG. 6 shows a control system for the separate control of the flow rate for nozzles arranged on various walls.

The different conditions as may prevail on various sides of the flow duct 18 can be taken into account more effectively via a control system 48, as shown in FIG. 6 for annular gap nozzles 24*. In the example shown, the flow rates of the media to be injected can be controlled independently of one another via the control system 48 and the valves 54 for that half 52 of the flow duct 18 which lies upstream with regard to the garbage flow 9 and that half 50 of the flow duct 18 which lies downstream with regard to the garbage flow 9. A separate control of the flow rates for the nozzles 24 on all four walls 26 would also be conceivable.

To regulate the temperature and the $O_2$ content and to achieve as long as possible a minimum dwell time of the flue-gas mixture flowing through the flow duct, nozzles 24 for secondary air and nozzles 24 for recirculated flue gas are preferably provided. These nozzles 24 may either be arranged in mixed configuration next to one another in a row or also in two rows one above the other, so that a separate injection plane 22 is obtained for each nozzle type 24. If annular gap nozzles 24* are provided, the core jet consists of flue gas and the annular jet consists of secondary air, as described for FIG. 5.

The embodiments shown here do not describe the invention in a definitive manner. Thus it is possible, for example, to also use the device in incineration plants and garbage incineration plants in which the transition region 20 between combustion chamber 12 and flue-gas outlet 10 is characterized by a constriction. Further injection planes 22 may also be provided at a lower level in the combustion chamber 12 or further up in the flue-gas outlet 10. Instead of or in addition to flue gas and secondary air, other media, such as steam, activated carbon, open-hearth coke, waste, e.g. in the course of residue recycling, fuels and the like, may also be injected. The device may also be used in order to obtain a reducing atmosphere. In the same direction of rotation as the first nozzles 24*a*, burners may be arranged 2 m to 3 m above the injection plane 22 on two opposite walls 26.

Figure 7:
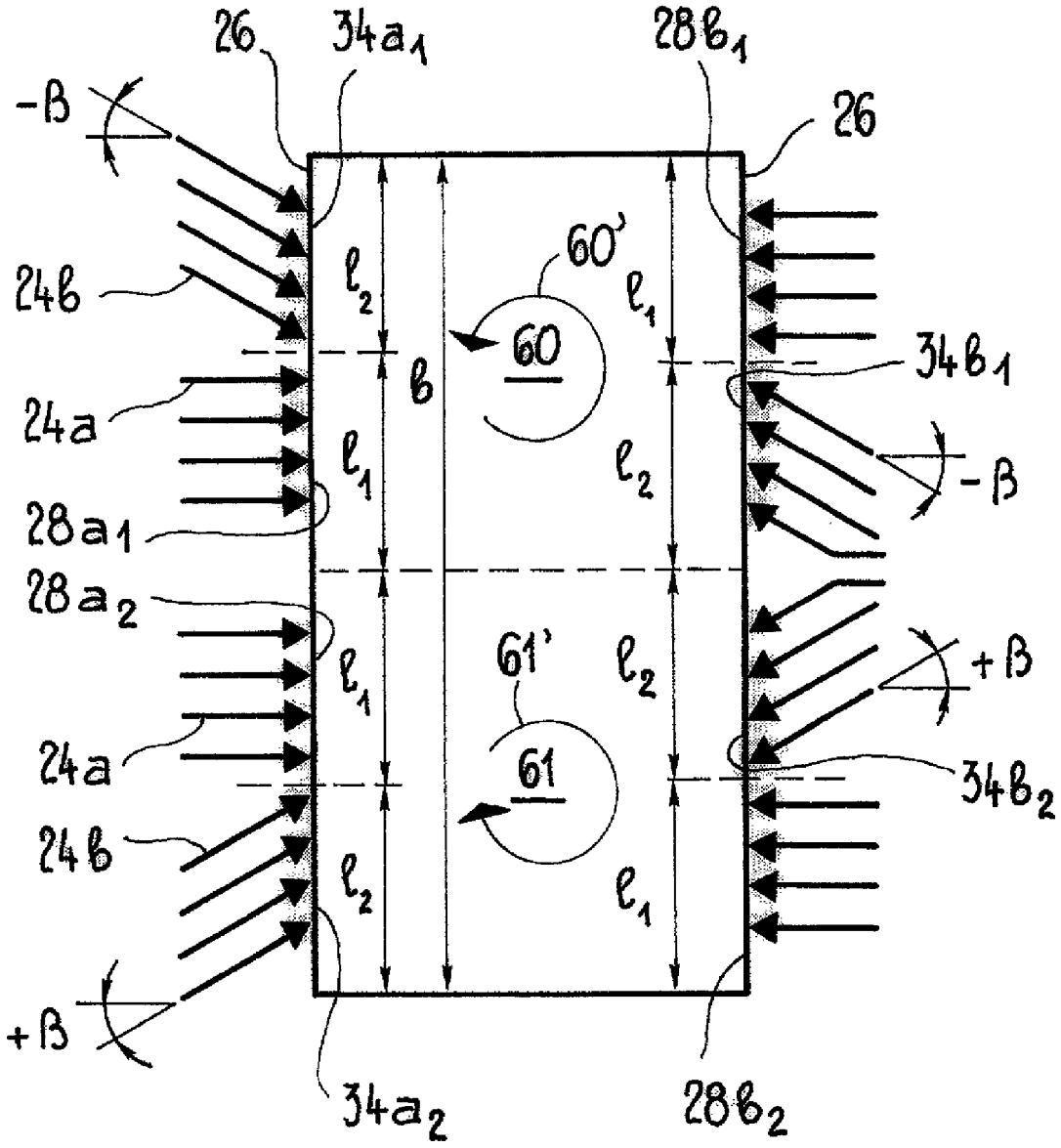
FIG. 7 shows a further embodiment of the device for producing at least two vortices rotating in opposite directions.

FIG. 7 shows a further embodiment of the device according to the invention, in which two vortices 60', 61' rotating in opposite directions are produced. The device is derived from the device shown in FIG. 2*b* by a mirrored arrangement on the bottom wall 26, i.e. the first and second nozzles shown there are doubled. The walls 26 of the device have in each case two first wall sections 28*a*1 and 28*a*2 and respectively 28*b*1 and 28*b*2 having first nozzles 24*a*. The first nozzles 24*a* of the first wall sections 28*a*2, 28*b*2 in the bottom half of the cross section are arranged diagonally opposite one another and produce a first vortex 61' rotating in the clockwise direction. This vortex 61' is intensified by the second nozzles 24*b* of the second wall sections 34*a*2, 34*b*2. The second nozzles 24*b* emit jets in a direction which is offset from the jet direction of the first nozzles by +/−β. These second wall regions 34*a*2, 34*b*2 are likewise diagonally opposite one another. The wall regions in the bottom half of the cross section shown define a first vortex region 61. A second vortex region 60 is defined by the first and second wall sections 28*a*1, 28*b*1, 34*a*1, 34*b*1 in the top part of FIG. 7. The second vortex 60' there rotates in the counter clockwise direction. The first wall sections 28*a*1, 28*a*2, 28*b*1, 28*b*2 each have a length $l_1$. A total length $L=l_1+l_1$ of about 0.5b is obtained for each wall 26. The first wall sections 28*a*1 and 28*b*1 (second vortex 60') and respectively 28*a*2 and 28*b*2 (second vortex 61') diagonally opposite one another establish the direction of rotation of the vortex 60', 61'. The second nozzles 24*b* then emit jets in such a way that they intensify the rotation, i.e. tangentially in the direction of rotation to an imaginary circle about the center of the vortex 60' or 61' respectively.

The invention is not limited by the embodiments described above which are presented as examples only but can be modified in various ways within the scope of protection defined by the appended patent claims.

We claim:

1. A device for producing a rotating flow in a rectangular flow duct which comprises a flue-gas outlet of an incineration plant, comprising: a flow duct having four walls in opposing wall pairs and a transition region from a combustion chamber of the incineration plant to the flue-gas outlet; a plurality of nozzles for media which can be emitted as a jet, the nozzles being arranged in an injection plane on two opposite walls defining the flow duct and having a wall width b, the nozzles including first nozzles oriented in a row in each case in at least one first wall section of the two opposite walls so that the first nozzles inject a jet into the injection plane wherein the injected jet and the wall form an angle γ lying in the injection plane, the angle γ being at least approximately 90°, a sum L of lengths l of the first wall sections being at least approximately $0.4b<L<0.8b$, and the at least one first wall section of the one wall being diagonally opposite the at least one first wall section of the opposite wall; and second nozzles arranged in each case in the injection plane in at least one second wall section of the two opposite walls so that for an angle β lying in the injection plane between the jets injected from the first and the second nozzles $|\beta|>0°$, each of the two opposite walls having at least two first wall sections so as to produce at least two vortices rotating in opposite directions, each of the two opposite walls additionally having two second wall sections, in each case a first wall section and a second wall section of the one wall forming a vortex region with the directly opposite second wall section and first wall section respectively of the opposite wall, the jets injected by the second nozzles being inclined toward the jets injected by the first nozzles by $+|\beta|$ in a first vortex region and by $-|\beta|$ in a second vortex region.

2. A device as defined in claim 1, wherein the opposite walls each have a first wall section, the first wall sections, with a center longitudinal axis of the flow duct as an axis of symmetry, being centrosymmetrically opposite one another and defined on one side by the adjacent wall.

3. A device as defined in claim 1, wherein the angle β, $20°<|\beta|<50°$.

4. A device as defined in claim 1, wherein the at least one second wall section of the one wall is diagonally opposite the at least one second wall section of the opposite wall.

5. A device as defined in claim 1, wherein, to produce a rotating vortex, each of the two opposite walls has a first wall section and a second wall section, the first and the second wall sections, with a center longitudinal axis of the flow duct as an axis of symmetry, in each case being centrosymmetrically opposite one another and defined on one side by the adjacent wall.

6. A device as defined in claim 1, wherein all four walls of the flow duct have a first wall section having first nozzles, the first wall sections being arranged in a peripheral direction against the rotating flow in each case at a start of the wall and at a distance from the first wall section of an adjacent wall.

7. The device as defined in claim 6, wherein the nozzles of all four walls lie in a common injection plane.

8. A device as defined in claim 1, wherein wall sections one of diagonally opposite one another and centrosymmetrically opposite one another have approximately a common length l.

9. A device as defined in claim 1, wherein the nozzles are annular gap nozzles.

10. A device as defined in claim 1, wherein the nozzles are operative to emit jets of secondary air and recirculated flue gas.

11. A device as defined in claim 1, wherein the injection plane lies in a region of a flame cover arranged in the transition region, the nozzles being arranged at least one of so as to pass through the flame cover and so as to be in walls laterally below the flame cover so that the nozzles cool the flame cover with injected jets.

12. A device for producing a rotating flow in a rectangular flow duct which comprises a flue-gas outlet of an incineration plant, comprising: a flow duct having four walls in opposing wall pairs and a transition region from a combustion chamber of the incineration plant to the flue-gas outlet; a plurality of nozzles for media which can be emitted as a jet, the nozzles being arranged in an injection plane on two opposite walls defining the flow duct and having a wall width b, the nozzles including first nozzles oriented in a row in each case in at least one first wall section of the two opposite walls so that the first nozzles inject a jet into the injection plane wherein the injected jet and the wall form an angle $\gamma$ lying in the injection plane, the angle $\gamma$ being at least approximately 90°, a sum L of lengths l of the first wall sections being at least approximately $0.4b<L<0.8b$, and the at least one first wall section of the one wall being diagonally opposite the at least one first wall section of the opposite wall; and second nozzles arranged in each case in the injection plane in at least one second wall section of the two opposite walls so that for an angle $\beta$ lying in the injection plane between the jets injected from the first and the second nozzles $|\beta|>0°$, wherein the second nozzles of the second wall section are oriented with an injection component at an angle $\alpha$ relative to the injection plane.

13. A device as defined in claim 12, wherein a is between 5° and 15°.

14. A device as defined in claim 12, wherein the second nozzles are arranged in a common plane in a direction of flow in the flow duct.

15. A device for producing a rotating flow in a rectangular flow duct which comprises a flue-gas outlet of an incineration plant, comprising: a flow duct having four walls in opposing wall pairs and a transition region from a combustion chamber of the incineration plant to the flue-gas outlet; a plurality of nozzles for media which can be emitted as a jet, the nozzles being arranged in an injection plane on two opposite walls defining the flow duct and having a wall width b, the nozzles including first nozzles oriented in a row in each case in at least one first wall section of the two opposite walls so that the first nozzles inject a jet into the injection plane wherein the injected jet and the wall form an angle $\gamma$ lying in the injection plane, the angle $\gamma$ being at least approximately 90°, a sum L of lengths l of the first wall sections being at least approximately $0.4b<L<0.8b$, and the at least one first wall section of the one wall being diagonally opposite the at least one first wall section of the opposite wall; and second nozzles arranged in each case in the injection plane in at least one second wall section of the two opposite walls so that for an angle $\beta$ lying in the injection plane between the jets injected from the first and the second nozzles $|\beta|>0°$, all four walls of the flow duct having a first wall section having first nozzles, the first wall sections being arranged in a peripheral direction against the rotating flow in each case at a start of the wall and at a distance from the first wall section of an adjacent wall, the nozzles being arranged in two parallel injection planes which are at a distance from one another in a flow direction, opposite nozzles lying in a common injection plane.

16. A device as defined in claim 15, wherein the nozzles are annular gap nozzles having a core jet that consists of recirculated flue gas and an annular jet that consists of secondary air.

17. A device for producing a rotating flow in a rectangular flow duct which comprises a flue-gas outlet of an incineration plant, comprising: a flow duct having four walls in opposing wall pairs and a transition region from a combustion chamber of the incineration plant to the flue-gas outlet; a plurality of nozzles for media which can be emitted as a jet, the nozzles being arranged in an injection plane on two opposite walls defining the flow duct and having a wall width b, the nozzles including first nozzles oriented in a row in each case in at least one first wall section of the two opposite walls so that the first nozzles inject a jet into the injection plane wherein the injected jet and the wall form an angle $\gamma$ lying in the injection plane, the angle $\gamma$ being at least approximately 90°, a sum L of lengths l of the first wall sections being at least approximately $0.4b<L<0.8b$, and the at least one first wall section of the one wall being diagonally opposite the at least one first wall section of the opposite wall; and second nozzles arranged in each case in the injection plane in at least one second wall section of the two opposite walls so that for an angle $\beta$ lying in the injection plane between the jets injected from the first and the second nozzles $|\beta|>0°$, wherein feed pressure, with which the media which can be emitted in the form of a jet pass into the nozzles, is between 500 Pa and 5000 Pa, and further comprising a control system operative to independently control flow rates for nozzles arranged on various of the walls.

18. A device for producing a rotating flow in a rectangular flow duct which comprises a flue-gas outlet of an incineration plant, comprising: a flow duct having four walls in opposing wall pairs and a transition region from a combustion chamber of the incineration plant to the flue-gas outlet; a plurality of nozzles for media which can be emitted as a jet, the nozzles being arranged in an injection plane on two opposite walls defining the flow duct and having a wall width b, the nozzles including first nozzles oriented in a row in each case in at least one first wall section of the two opposite walls so that the first nozzles inject a jet into the injection plane wherein the injected jet and the wall form an angle $\gamma$ ling in the injection plane, the angle $\gamma$ being at least approximately 90°, a sum L of lengths l of the first wall sections being at least approximately $0.4b<L<0.8b$, and the at least one first wall section of the one wall being diagonally opposite the at least one first wall section of the opposite wall; and second nozzles arranged in each case in the injection plane in at least one second wall section of the two opposite walls so that for an angle $\beta$ lying in the injection plane between the jets injected from the first and the second nozzles $|\beta|>0°$, all four walls of the flow duct having a first wall section having first nozzles, the first wall sections being arranged in a peripheral direction against the rotating flow in each case at a start of the wall and at a distance from the first wall section of an adjacent wall, the nozzles of all four walls lying in a common injection plane, wherein the nozzles are annular gap nozzles having a core jet that consists of recirculated flue gas and an annular jet that consists of secondary air.

* * * * *